US007785079B2

(12) United States Patent
Ono et al.

(10) Patent No.: US 7,785,079 B2
(45) Date of Patent: Aug. 31, 2010

(54) COMPRESSOR AND METHOD OF USING COMPRESSOR

(75) Inventors: Makoto Ono, Aichi (JP); Wataru Sakuma, Aichi (JP)

(73) Assignees: Toyota Boshoku Kabushiki Kaisya, Kariya-shi (JP); Aichi Micro Intelligent Corporation, Tokai-shi (JP)

( * ) Notice: Subject to any disclaimer, the term of this patent is extended or adjusted under 35 U.S.C. 154(b) by 405 days.

(21) Appl. No.: 11/312,589

(22) Filed: Dec. 21, 2005

(65) Prior Publication Data

US 2006/0171817 A1 Aug. 3, 2006

(30) Foreign Application Priority Data

Dec. 22, 2004 (JP) ..... 2004-372142

(51) Int. Cl.
*F04B 49/00* (2006.01)

(52) U.S. Cl. ..... 417/63; 417/222.1

(58) Field of Classification Search ..... 417/63, 417/223, 222.1
See application file for complete search history.

(56) References Cited

U.S. PATENT DOCUMENTS 4,056,747 A * 11/1977 Orris et al. ..... 310/155
4,355,959 A * 10/1982 Kono et al. ..... 417/223
4,480,961 A * 11/1984 Kono et al. ..... 417/15
4,701,109 A * 10/1987 Daikohara ..... 417/223
4,704,072 A * 11/1987 Nakajima et al. ..... 417/223
4,737,079 A 4/1988 Kurosawa et al.
4,781,538 A * 11/1988 Daikohara ..... 417/223
4,783,609 A * 11/1988 Sugiyama et al. ..... 310/168
4,867,648 A * 9/1989 Murayama ..... 417/222.2
5,022,826 A * 6/1991 Matsuda et al. ..... 417/63
5,046,927 A * 9/1991 Ohno et al. ..... 417/222.2
5,059,097 A 10/1991 Okazaki et al.
5,100,301 A * 3/1992 Hidaka et al. ..... 417/222.2
5,380,161 A * 1/1995 Takenaka et al. ..... 417/222.2
5,407,328 A * 4/1995 Kimura et al. ..... 417/222.1
5,540,560 A * 7/1996 Kimura et al. ..... 417/223
5,749,710 A * 5/1998 Kimura et al. ..... 417/63
6,247,900 B1 * 6/2001 Archibald et al. ..... 417/222.1

(Continued)

FOREIGN PATENT DOCUMENTS

EP 0 744 548 A2 11/1996

(Continued)

*Primary Examiner*—Devon C Kramer
*Assistant Examiner*—Amene S Bayou
(74) *Attorney, Agent, or Firm*—Oblon, Spivak, McClelland, Maier & Neustadt, L.L.P.

(57) ABSTRACT

A compressor of the present invention is provided with a plurality of housing members (a front housing, a cylinder block, and a rear housing) that forms a body, a fastener (a bolt member) for coupling the plurality of the housing members to one another, a drive shaft inserted through the body and coupled to a power source via an electromagnetic clutch, a movable member (a piston) that moves in association with the drive shaft to compress a fluid, a detection body that moves in association with the drive shaft, and a detection part for detecting a rotational state of the drive shaft by means of the detection body. A magnetic sensor having a magnetic impedance element constitutes the detection part. The magnetic sensor is provided on an outer lateral face side of the body and in proximity to the fastener.

8 Claims, 2 Drawing Sheets

U.S. PATENT DOCUMENTS 6,247,902 B1 * 6/2001 Obayashi et al. ..... 417/223
6,848,888 B2 * 2/2005 Du et al. ..... 417/53

FOREIGN PATENT DOCUMENTS

JP 6-299960 10/1994
JP 2002-195854 7/2002
JP 2002195854 A * 7/2002

* cited by examiner

COMPRESSOR AND METHOD OF USING COMPRESSOR

The disclosure of Japanese Patent Application No. 2004-372142 filed on Dec. 22, 2004, including the specification, drawings and abstract is incorporated herein by reference in its entirety.

BACKGROUND OF THE INVENTION

1. Field of the Invention

The present invention relates to a compressor and a method of using the compressor, and more particularly, to a compressor with a compact and inexpensive structure which does not require drilling a body thereof and a method of using the compressor.

2. Description of the Related Art

A compressor for air-conditioning of a vehicle, which is provided with a rotation detecting mechanism to detect a rotational failure resulting from seizure or the like, has been conventionally known. The rotation detecting mechanism is constructed, for example, by forming a through-hole 102 through a housing member 101 made of a nonmagnetic material and fitting a detection sensor 104 in the through-hole 102 via an O-ring 103 as shown in FIG. 5. The detection sensor 104 converts a change in a magnetic flux flowing from a magnet 106 to an iron core 107 in accordance with rotation of the detection body 105 into a voltage by means of a pickup coil 108, thereby detecting a rotational state of the detection body 105.

In the above described conventional rotation detecting mechanism, however, the housing member 101 needs to be drilled so as to form the through-hole 102, which leads to an increase in the production cost of the compressor. Further, a sealing structure employing the O-ring 103 is required, which leads to a further increase in the production cost of the compressor. In addition, there is a problem, for example, that foreign matters that have adhered to the detection sensor 104 may enter the compressor and cause seizure of the compressor.

In view of this background, a conventional compressor is known, which solves the above described problem (e.g., see Patent Documents 1 and 2). In this conventional compressor, a detection sensor is provided outside a housing member, and there is no need to drill the housing member.

In the compressor disclosed in the above-mentioned Patent Document 1, a detector 18 is provided outside a body of the compressor, and a magnetic flux leaking out from an electromagnetic clutch 6 is sequentially conducted through a drive shaft 7, a rotational base 8 (a detection body) moving in association with the drive shaft 7, and a bolt 14 (a fastener) for connecting the body, so that a circulative magnetic circuit is formed. A change in the magnetic flux is caused between the rotational base 8 and the bolt 14 via a periodic motion of the rotational base 8, and the detector 18 detects the change in the magnetic flux. A rotational speed of the compressor is detected based on this change, that is, a detection result obtained from the detector 18. Thus, this compressor is advantageous in that high detecting performance can be achieved with a simple construction.

In the compressor disclosed in the above-mentioned Patent Document 2, a magnetic sensor 150 having a magnetic impedance element (an MI element) whose impedance changes according to an external magnetic field is provided outside a body 1 of the compressor, and a permanent magnet 7 serving as a magnetic flux generating source is embedded in an outer peripheral portion of a swash plate 6 serving as a detection body. In addition, the permanent magnet 7 and the magnetic sensor 150 are so arranged as to face each other sometime while the swash plate 6 rotates by 360°. With this construction, since the magnetic element of the magnetic sensor 150 is a high-sensitivity MI element, subtle fluctuations in the magnetic field resulting from rotation of the swash plate 6 can be detected even from the outside of the body 1. Consequently, this compressor is advantageous, for example, in that detection of a rotational speed is made possible with high sensitivity and high accuracy.

According to the above-mentioned Patent Document 1, however, a magnetic sensor is arranged at a head portion of the fastener or on a stator side of the electromagnetic clutch 6 facing the fastener. This causes a problem that the axial total length of the compressor is increased because of a space for mounting the sensor.

According to the above-mentioned Patent Document 2, the magnetic flux generating source (the permanent magnet 7) is provided in the detection body inside the compressor. Therefore, this magnetic flux generating source may fall from the detection body and cause seizure or the like of the compressor. Besides, there is a problem, for example, that the necessity of the magnetic flux generating source entails an increase in the production cost of the compressor.

Patent Document 1: Japanese Patent Application Publication No. Hei 6-299960

Patent Document 2: Japanese Patent Application Publication No. 2002-195854

SUMMARY OF THE INVENTION

As described above, the present invention has been conceived of in view of the foregoing circumstances. It is an object of the present invention to provide a compressor with a compact and inexpensive structure which does not require drilling a body thereof and a method of using the compressor.

The present invention has the following structure:

1. A compressor comprising:

a plurality of housing members forming a body;

a fastener that couples said plurality of housing members to one another;

an electromagnetic clutch provided on one end side of said body;

a drive shaft inserted through said body and coupled to a power source via said electromagnetic clutch;

a movable member that moves in association with said drive shaft to compress a fluid;

a detection body that moves in association with said drive shaft; and detection means for detecting a rotational state of said drive shaft by means of said detection body, wherein said detection body and said drive shaft are made of a ferromagnetic material, a magnetic flux leaking out from said electromagnetic clutch is sequentially conducted from an outer lateral face side of said body to said detection body and said drive shaft so as to form a circulative magnetic path, said detection means is a magnetic sensor having a magnetic impedance element, and said magnetic sensor is provided on the outer lateral face side of said body and in proximity to said fastener.

2. The compressor according to 1 above, wherein said detection body is arranged between said electromagnetic clutch and said movable member, and said magnetic sensor is arranged at a position facing said detection body via said fastener.

3. The compressor according to 1 above, wherein said fastener is made of a ferromagnetic material.
4. The compressor according to 1 above, wherein said magnetic sensor and said fastener are spaced apart from each other by a clearance equal to or smaller than 20 mm.
5. The compressor according to 1 above, wherein said magnetic sensor is arranged such that a center thereof is located at a position that is shifted toward the other side of said electromagnetic clutch on said body by a distance equal to or smaller than 40 mm from a position where a radial end face of said detection body faces an outer lateral face of said body via said fastener.
6. The compressor according to 1 above, wherein said housing members are made of a nonmagnetic material.
7. The compressor according to 1 above, wherein said detection body, said drive shaft, and said fastener are made of iron, and said housing members are made of aluminum.

8. A method of using the compressor according to 1 above for air-conditioning of a vehicle.

According to the compressor of the present invention, the magnetic flux leaking out from the electromagnetic clutch is sequentially conducted through the detection body and the drive shaft from the outer lateral face side of the body, so that the circulative magnetic circuit is formed. The magnetic sensor detects a change in the magnetic flux in the circulative magnetic circuit from the outer lateral face side of the housing member, thereby detecting a rotational speed of the compressor. As a result, the compressor, which has a compact and inexpensive structure that does not require drilling the body thereof, can be provided.

If the detection body is arranged between the electromagnetic clutch and the movable member and the magnetic sensor is arranged at a position facing the detection body via the fastener, the change in the magnetic flux in the circulative magnetic circuit can be detected more reliably.

If the fastener is made of a ferromagnetic material, the magnetic flux leaking out from the electromagnetic clutch is sequentially conducted through the fastener, the detection body, and the drive shaft from the outer lateral face side of the body, so that the circulative magnetic circuit is formed. Consequently, the change in the magnetic flux in the circulative magnetic circuit is detected more easily.

If the clearance between the magnetic sensor and the fastener is equal to or smaller than 20 mm, the change in the magnetic flux in the circulative magnetic circuit is detected more easily.

If the magnetic sensor is arranged such that a center thereof is located at a position that is shifted toward the other side of the electromagnetic clutch on the body by a distance equal to or smaller than 40 mm from a position where a radial end face of the detection body faces an outer lateral face of the body via the fastener, the change in the magnetic flux in the circulative magnetic circuit is detected more easily.

If the housing member is made of a nonmagnetic material, the change in the magnetic flux in the circulative magnetic circuit is detected more easily.

If the detection body, the drive shaft, and the fastener are made of iron and the housing member is made of aluminum, the change in the magnetic flux in the circulative magnetic circuit is detected more easily.

In the method of using the compressor according to the present invention, the compressor is appropriately used for air-conditioning of the vehicle.

DETAILED DESCRIPTION OF THE INVENTION

1. Compressor

Figure 1:
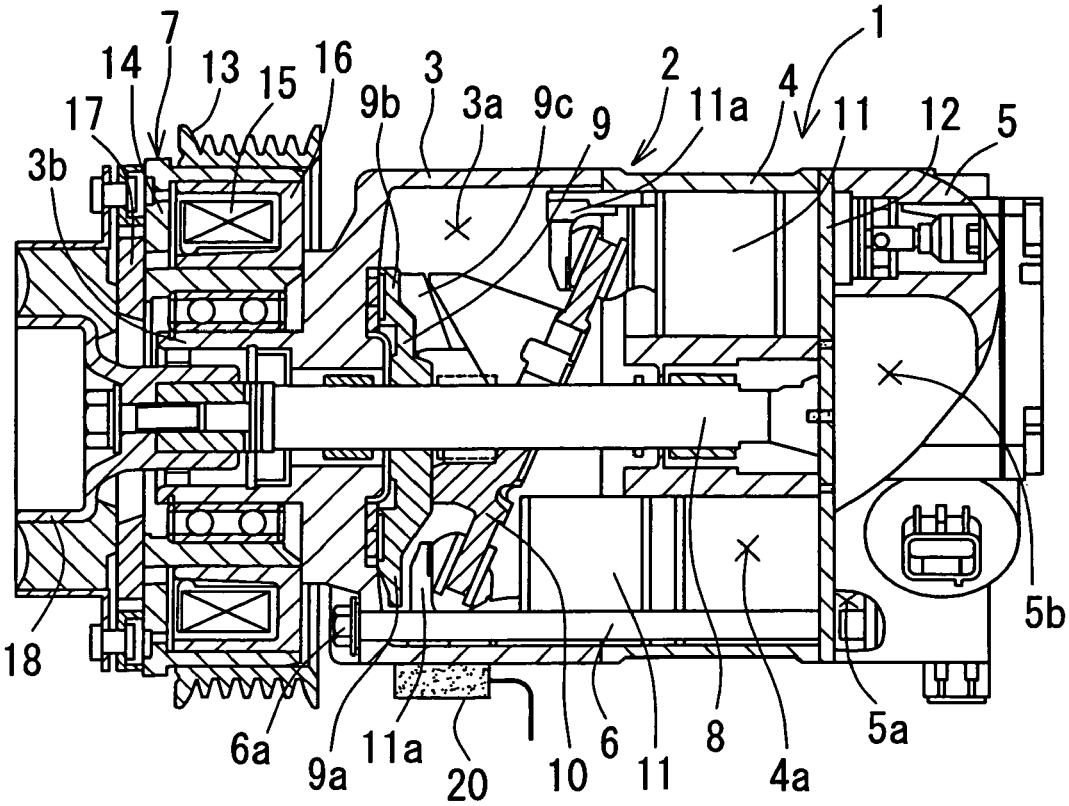
FIG. 1 is a sectional view showing a compressor according to an embodiment of the present invention.

A compressor according to the present invention is provided with the following components, that is, a housing member, a fastener, a drive shaft, a movable member, a detection body, and detection means. This compressor may further be provided with, for example, a swash plate which will be described later.

The type of compression performed by the compressor may be, for example, reciprocating compression, scroll compression, screw compression, or vane compression.

The "housing member" is not limited to any specific material, shape, or the like as long as two or more of housing members of the same type can be combined to form a body of the compressor. The number of the housing members to be provided is not limited in particular either. The housing member may be made of, for example, a nonmagnetic material such as aluminum. The housing member may be, for example, a front housing, a cylinder block, a rear housing, and the like.

The "fastener" is not limited to any specific structure, shape, or the like as long as it can couple a plurality of housing members to one another. Two or more fasteners of the same type may also be provided, and the number of the fasteners to be provided is not limited in particular either. The fastener may be, for example, a bolt member inserted through an interior of the body and extending in an axial direction thereof. The fastener may be made of, for example, a ferromagnetic material such as iron.

The "drive shaft" is not limited to any specific material, shape, length, or the like as long as it can be inserted through the body and coupled to a power source via an electromagnetic clutch. The drive shaft is normally supported in a rotatable manner in the body. The drive shaft may be made of any ferromagnetic material (e.g., iron or the like).

Note that the electromagnetic clutch is normally supported in a rotatable manner on a tip end side of a front housing that acts as a housing member. The power source may be, for example, an internal combustion engine, an electric motor, or the like.

The "movable member" is not limited to any specific structure, mode of movement, or the like as long as it can move in association with the drive shaft and compress a fluid. The movable member may be, for example, a piston, a scroll, a screw, a vane, or the like. A suitable one of them is selected according to the mode of compression of the compressor or the like.

The "detection body" is not limited to any specific material, shape, mode of movement, or the like as long as it can move in association with the drive shaft. The detection body can cause a change in clearance between itself and the fastener and thus a change in the magnetic flux in a circulative magnetic circuit A (see FIG. 2) by, for example, moving in association with the drive shaft. The circulative magnetic circuit A is normally formed by conducting a magnetic flux leaking out from the electromagnetic clutch sequentially through the detection body and the drive shaft from an outer lateral face side of the body. The circulative magnetic circuit A may be formed by, for example, conducting the magnetic flux leaking out from the electromagnetic clutch sequentially through the fastener, the detection body, and the drive shaft from the outer lateral face side of the body. Furthermore, the circulative magnetic circuit A may be formed by, for example, conducting a magnetic flux leaking out from the electromagnetic clutch sequentially through a stator, a pulley, the housing member, the fastener, the detection body, and the drive shaft. The detection body is not provided with a magnetic flux generating source (a permanent magnet or the like).

The detection body may be, for example, attached to the drive shaft and rotatable together therewith. The detection body may be made of any ferromagnetic material (e.g., iron or the like). The detection body may assume the shape of, for example, a circular disc, and have one, two, or more reduced diameter portions or projecting portions for causing a change in the magnetic flux on an outer periphery side thereof.

The detection body may be arranged, for example, between the electromagnetic clutch and the movable member. It is preferable from the standpoint of detection accuracy that the detection body be arranged at a position close to the electromagnetic clutch in the front housing that acts as the housing member.

The "detection means" detects a change in the magnetic flux in the circulative magnetic circuit A caused by the detection body, and then a rotational state of the drive shaft. The detection means is a magnetic sensor having a magnetic impedance element.

The "magnetic sensor" is not limited to any specific shape, size, or the like as long as it is provided on the outer lateral face side of the body and in proximity to the fastener. Two or more magnetic sensors of the same type may also be provided, and the number of the magnetic sensors to be provided is not limited in particular either. The mode of arrangement of the magnetic sensor may be, for example, (1) a mode in which the magnetic sensor is provided in contact with an outer lateral face of the body, (2) a mode in which the magnetic sensor is provided in a recess portion formed in the outer lateral face of the body, (3) a mode in which the magnetic sensor is provided outwardly apart from the outer lateral face of the body, or the like. The magnetic sensor may be arranged, for example, such that a magnetism-sensing direction P thereof coincides with the axial direction of the body (see FIG. 1) or extends perpendicularly to the axial direction of the body (see FIG. 4).

The magnetic sensor may be arranged, for example, at a position facing the detection body without the intervention of the fastener. From the standpoint of detection accuracy, however, it is preferable that the magnetic sensor be arranged at the position facing the detection body via the fastener.

The clearance between the magnetic sensor and the fastener may be, for example, equal to or smaller than 20 mm. The clearance may be, for example, equal to or larger than 0 mm.

The magnetic sensor may be arranged, for example, such that a center thereof is located at a position that is shifted toward the other side of the electromagnetic clutch on the body by a distance equal to or smaller than 40 mm from a position where a radial end face of the detection body faces an outer lateral face of the body via said fastener. The distance may be, for example, equal to or larger than 0 mm.

The "magnetic impedance element" is not limited to any specific material, shape, size, or the like as long as it is an element utilizing a phenomenon of a change in impedance with respect to high-frequency current resulting from a change in an external magnetic field (i.e., a magnetic impedance effect). The magnetic impedance element may be, for example, a wire made of an amorphous magnetic material, a thin-film element made of ferronickel etc., or the like.

By applying a high-frequency current to the magnetic impedance element and converting a change in impedance caused as a result of a change in the external magnetic field into an electric signal, an output of the magnetic impedance element is obtained.

The "swash plate" is not limited to any specific material, shape, mode of movement, or the like as long as it moves in association with the drive shaft. The swash plate is normally supported in a tiltable manner on the drive shaft, and tilts with respect to the drive shaft in accordance with rotation thereof, thereby moving the movable member.

Preferred Embodiments

Hereinafter, an embodiment of the present invention will be described in detail with reference to the drawings.

In this embodiment, a variable displacement compressor for air-conditioning of a vehicle, whose compression volume changes in accordance with a change in tilt angle of a later-described swash plate, is described as an example of the compressor according to the present invention.

(1) Structure of Compressor

As shown in FIG. 1, a compressor 1 according to the present embodiment has a body 2 composed of a front housing 3, a cylinder block 4, and a rear housing 5, which are examples of the "housing member" according to the present invention. The front housing 3, the cylinder block 4, and the rear housing 5 are tubular in shape and made of aluminum (a nonmagnetic material). With a rear end of the front housing 3 abutting against a front end of the cylinder block 4 and a front end of the rear housing 5 abutting against a rear end of the cylinder block 4 via a valve plate 12, screw portions (not shown) of a plurality of bolt members 6 (that is an example of the "fastener" according to the present invention), which are made of a ferrous metal (a ferromagnetic material), are screwed into the rear housing 5, and head portions 6*a* of the respective bolt members 6 are engaged with an outer end face of the front housing 3. As a result, the front housing 3, the cylinder block 4, and the rear housing 5 are integrally coupled to one another.

Figure 3:
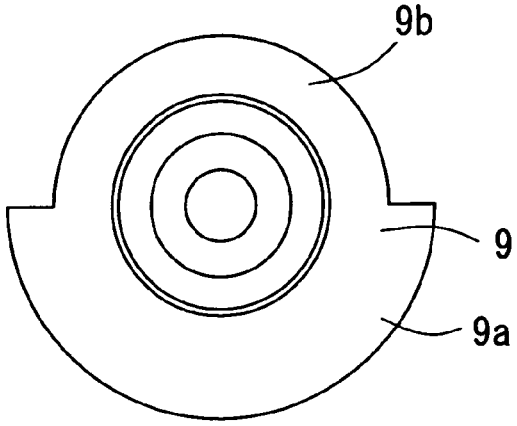
FIG. 3 is a front view showing a detection body.

A drive shaft 8, which is made of a ferrous metal (a ferromagnetic material) and coupled to an engine (not shown) via an electromagnetic clutch 7, is inserted through a crank chamber 3*a* formed in the front housing 3. The drive shaft 8 is rotatably supported via a bearing in the cylinder block 4 and the front housing 3. A detection body 9 having the shape of a circular disc and made of a ferrous metal (a ferromagnetic material) is fixed to the drive shaft 8. The detection body 9 is arranged between the electromagnetic clutch 7 and a later-described piston and at a position close to the electromagnetic clutch 7 in the front housing 3. In order to cause a change in the magnetic flux in a later-described circulative magnetic circuit, an increased diameter portion 9*a* and a reduced diameter portion 9*b*, which are circumferentially arranged at intervals of a predetermined angle (180°), are formed on an outer periphery side of the detection body 9 (see FIG. 3). A swash plate 10 is tiltably provided on the drive shaft 8. The swash plate 10 tilts within a predetermined angular range by being guided by a guide portion 9c of the rotating detection body 9.

A piston 11, which is an example of the "movable member" according to the present invention, is supported in a plurality of cylinder chambers 4*a* formed in the cylinder block 4 in such a manner as to be movable in the axial direction of the body 2. An outer periphery end portion of the swash plate 10 is coupled to a coupling portion 11*a* formed on a front side of the piston 11. Due to rotation of the drive shaft 8 and the detection body 9, therefore, the swash plate 10 is tilted, and the piston 11 is reciprocated in a corresponding one of the cylinder chambers 4*a*. Owing to this reciprocating movement of the piston 11, a refrigerant gas sucked from a suction chamber 5*a* formed in the rear housing 5 into the cylinder chamber 4*a* is compressed. The compressed gas is discharged into a discharge chamber 5*b* formed in the rear housing 5.

The electromagnetic clutch 7 is rotatably supported on a boss portion 3*b* of the front housing 3 via a bearing. The electromagnetic clutch 7 is composed of a pulley 13, a rotor 14, a stator 16, an armature 17, and a hub 18. The pulley 13 is coupled to a crank pulley of an engine, which is an example of the "power source" according to the present invention, via a V belt (not shown). The rotor 14 is fixed to an inner periphery side of the pulley 13. The stator 16 is fixed to the rotor 14 and incorporates an electromagnetic coil 15. The armature 17 assumes the shape of a circular disc and is arranged facing a conductive frictional surface of the rotor 14. The hub 18 couples the armature 17 to the drive shaft 8.

Figure 2:
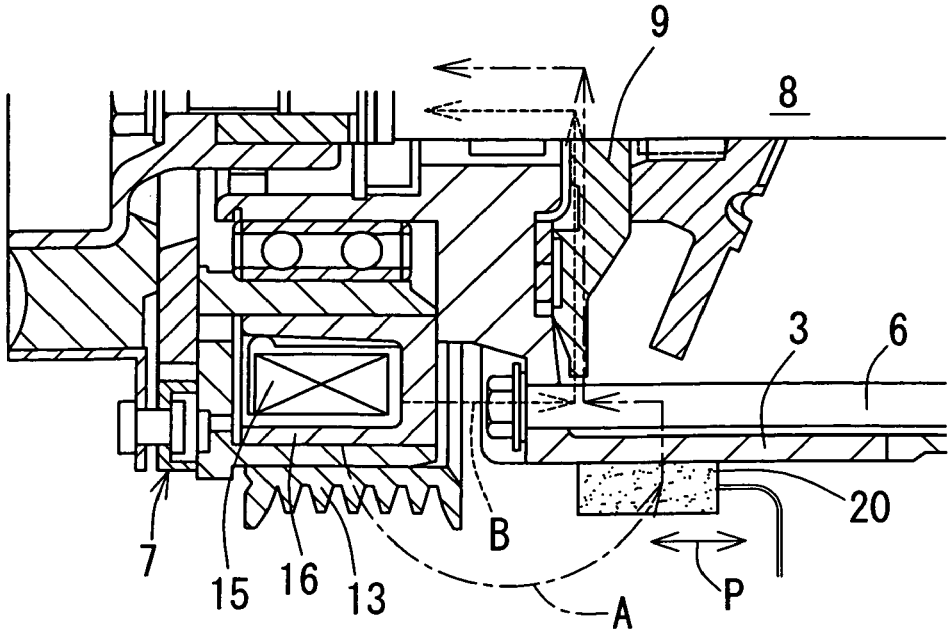
FIG. 2 is an enlarged view of an essential part of FIG. 1.

As shown in FIG. 2, a magnetic flux leaking out from the electromagnetic coil 15 of the electromagnetic clutch 7 is sequentially conducted through the stator 16, the pulley 13, the front housing 3, a corresponding one of the bolt members 6, the detection body 9, and the drive shaft 8, so that the circulative magnetic circuit A (indicated by alternate long and short dash lines in FIG. 2) is formed. Also, a magnetic flux leaking out from the electromagnetic coil 15 of the electromagnetic clutch 7 is sequentially conducted through the stator 16, a corresponding one of the bolt members 6, the detection body 9, and the drive shaft 8, so that the circulative magnetic circuit B (indicated by dashed lines in FIG. 2) is formed.

A magnetic sensor 20, which is an example of the "detection means" according to the present invention, capable of detecting a change in the magnetic flux in the circulative magnetic circuit A is provided on an outer lateral face of the front housing 3 and in proximity to the bolt member 6. The magnetic sensor 20 has a magnetic impedance element (not shown) that is a wire made of an amorphous magnetic material. The magnetic sensor 20 is arranged at a position facing the detection body 9 via the bolt member 6. The clearance between the magnetic sensor 20 and the bolt member 6 is equal to or smaller than 20 mm (for example, 10 mm). The center of the magnetic sensor 20 is arranged at a position that is shifted toward the other side of the electromagnetic clutch 7 on the body 2 by a distance equal to or smaller than 40 mm (for example, 20 mm) from a position where a radial end face of the detection body 9 faces the outer lateral face of the front housing 3 via the bolt member 6. The magnetic sensor 20 is arranged such that the magnetism-sensing direction P thereof coincides with the axial direction of the body 2.

(2) Operation of Compressor

Next, an operation of the compressor 1 having the aforementioned structure will be described.

When a voltage is applied to the electromagnetic coil 15 in the electromagnetic clutch 7, a magnetic field is generated, and the pulley 13 is coupled to the hub 18. Since the hub 18 is joined to the drive shaft 8 and the detection body 9, power of the engine is transmitted to the pulley 13. As a result, the pulley 13, the drive shaft 8, and the detection body 9 rotate at the same time. Then, the swash plate 10 tilts due to rotation of the detection body 9, and the piston 11 reciprocates in the corresponding one of the cylinder chambers 4*a*. In consequence, the refrigerant gas sucked from the suction chamber 5*a* of the rear housing 5 into the cylinder chamber 4*a* is compressed, and the compressed gas is discharged into the discharge chamber 5*b* of the rear housing 5.

At this moment, the circulative magnetic circuit A and a circulative magnetic circuit B (see FIG. 2) are formed owing to a magnetic field (a magnetic flux) generated from the electromagnetic clutch 7. Because of the shape of the detection body 9 (see FIG. 3), the detection body 9 changes in radius during a 360° rotation. Therefore, when the detection body 9 rotates, the clearance (air gap) between the bolt member 6 and the detection body 9 changes, which causes changes in the magnetic fields in the circulative magnetic circuits A and B. The output voltage of the magnetic sensor 20, which detects the change in the magnetic field in the circulative magnetic circuit A, changes. Based on this change in the output voltage, a rotational state of the compressor 1 is detected.

(3) Effects of the Embodiment

In this embodiment, as described above, the magnetic sensor 20 having the magnetic impedance element is provided on the outer lateral face of the front housing 3 forming the body 2 and in proximity to the bolt member 6 so as to constitute the compressor 1. Therefore, the magnetic flux leaking out from the electromagnetic clutch 7 is sequentially conducted through the stator 16, the pulley 13, the front housing 3, the bolt member 6, the detection body 9, and the drive shaft 8, so that the circulative magnetic circuit A is formed. The magnetic sensor 20 detects a change in the magnetic flux in the circulative magnetic circuit A from the outer lateral face of the front housing 3. As a result, a rotational state of the compressor 1 is detected. This eliminates the necessity to drill the body 2 of the compressor 1. Consequently, the production cost of the compressor can be reduced in comparison with a conventional one with its body drilled. Since a sealing structure employing an O-ring is not required, the production cost can further be reduced. Moreover, foreign matters stuck to the magnetic sensor are prevented from entering the compressor and causing seizure or the like. Since there is no need to provide a space for mounting the sensor between the electromagnetic clutch 7 and the front end face of the front housing 3 unlike conventional cases in which detection means is provided on a head portion of a bolt member or on a stator side of an electromagnetic clutch facing the head portion, the total length in the axial direction of the body of the compressor can be reduced. In addition, since no magnetic flux generating source is required unlike conventional cases in which a magnetic flux generating source (a permanent magnet) is provided to a detection body, the production cost can further be reduced. There is no possibility of such a magnetic flux generating source falling from the detection body and causing seizure or the like.

In this embodiment, the detection body 9 is arranged between the electromagnetic clutch 7 and the piston 11, and the magnetic sensor 20 is arranged at the position facing the detection body 9 via the bolt member 6. Therefore, the magnetic sensor 20 is located closer to the circulative magnetic circuit A, and a change in the magnetism in the circulative magnetic circuit A can be detected with extremely high accuracy.

Figure 4:
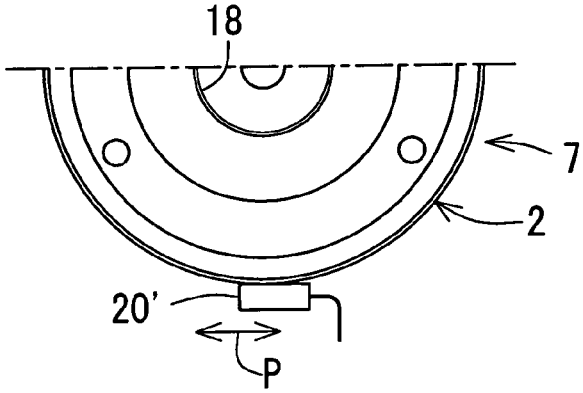
FIG. 4 is an illustrative view for explaining another mode of arrangement of a magnetic sensor.
Figure 5:
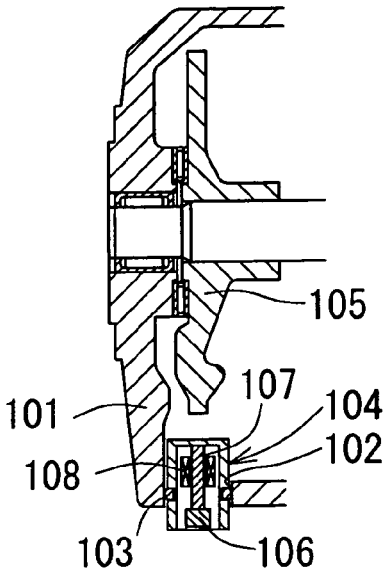
FIG. 5 Prior Art
FIG. 5 is a sectional view showing a conventional compressor.

Note that, the present invention is not limited to the above described embodiment, and permits within its scope a variety of modifications and changes depending on the purpose or use to which the present invention is applied. That is, although the magnetic sensor 20 is arranged such that the magnetism-sensing direction P thereof coincides with the axial direction of the body 2 of the compressor 1, the present invention is not limited thereto. For example, as shown in FIG. 4, a magnetic sensor 20' may be arranged such that the magnetism-sensing direction P thereof extends substantially perpendicularly to the axial direction of the body 2 of the compressor 1 or forms a predetermined angle therewith.

In the above described embodiment, the detection body 9 having the pair of the increased diameter portion 9*a* and the reduced diameter portion 9*b* is described as an example. However, the present invention is not limited thereto; for example, a plurality of recess portions (reduced diameter portions) may be formed circumferentially at intervals of a predetermined distance on an outer periphery side of the detection body 9.

The compressor of the present invention is utilized as a compressor for a vehicle. In particular, it is preferably utilized as a compressor for air-conditioning of a vehicle.

What is claimed is:

1. A compressor comprising:

a plurality of housing members forming a body;

a fastener that couples said plurality of housing members to one another;

an electromagnetic clutch provided on one end side of said body;

a drive shaft inserted through said body and coupled to a power source via said electromagnetic clutch;

said body having an outer lateral face side that extends parallel to said drive shaft;

a movable member that moves in association with said drive shaft to compress a fluid;

a detection body that moves in association with said drive shaft; and a magnetic sensor to detect a rotational state of said drive shaft by means of said detection body, said magnetic sensor having a magnetic impedance element that detects changes in a circulative magnetic flux, the circulative magnetic flux including only the magnetic flux leaking out from said electromagnetic clutch that is sequentially conducted from an outer lateral face side of said body to said detection body, via said fastener, and said drive shaft so as to form a circulative magnetic path, wherein said detection body and said drive shaft are made of a ferromagnetic material, said magnetic sensor is provided at or near the outer lateral face side of said body, said detection body has a radially extending end face which faces the outer lateral face side of the body and said magnetic sensor via said fastener, said magnetic sensor is located radially outwardly from the radially extending end face of the detection body, said magnetic sensor is in proximity to said fastener, and a length of the space between the fastener and the outer lateral face side of the body directly above said magnetic sensor in a direction perpendicular to said drive shaft is less than the length of the outer lateral face side of the body directly above said magnetic sensor in a direction perpendicular to said drive shaft.

2. The compressor according to claim 1, wherein said detection body is arranged between said electromagnetic clutch and said movable member.

3. The compressor according to claim 1, wherein said fastener is made of a ferromagnetic material.

4. The compressor according to claim 1, wherein said magnetic sensor and said fastener are spaced apart from each other by a clearance equal to or smaller than 20 mm.

5. The compressor according to claim 1, wherein said magnetic sensor is arranged such that a center thereof is located at a position toward the other side of said electromagnetic clutch on said body by a distance equal to or smaller than 40 mm from a position where a radial end face of said detection body faces an outer lateral face of said body via said fastener.

6. The compressor according to claim 1, wherein said housing members are made of a nonmagnetic material.

7. The compressor according to claim 1, wherein said detection body, said drive shaft, and said fastener are made of iron, and said housing members are made of aluminum.

8. A method of using the compressor according to claim 1 for air-conditioning of a vehicle.

* * * * *